US008302362B2

(12) United States Patent
Rischmueller et al.

(10) Patent No.: US 8,302,362 B2
(45) **Date of Patent: *Nov. 6, 2012**

(54) MODULAR DECKING SYSTEM AND AN IMPROVED TREAD AND BEARER LOCATING SYSTEM THEREFOR

(75) Inventors: Guy R. Rischmueller, Yundi (AU); Franek Savarton, Yundi (AU)

(73) Assignee: Ecoform Pty Ltd, Victoria (AU)

( * ) Notice: Subject to any disclaimer, the term of this patent is extended or adjusted under 35 U.S.C. 154(b) by 497 days.

This patent is subject to a terminal disclaimer.

(21) Appl. No.: 12/375,319

(22) PCT Filed: Jun. 27, 2007

(86) PCT No.: PCT/AU2007/000880

§ 371 (c)(1),
(2), (4) Date: Aug. 17, 2009

(87) PCT Pub. No.: WO2008/000021

PCT Pub. Date: Jan. 3, 2008

(65) Prior Publication Data

US 2009/0301024 A1 Dec. 10, 2009

(30) Foreign Application Priority Data

Jun. 27, 2006 (AU) ..... 2006903432

(51) Int. Cl.
*E04H 12/00* (2006.01)

(52) U.S. Cl. ..... 52/650.3; 52/169.9; 52/177; 52/263

(58) Field of Classification Search ..... 52/169.9, 52/177, 263, 650.3

See application file for complete search history.

(56) References Cited

U.S. PATENT DOCUMENTS

| | | | | |
|---|---|---|---|---|
| 3,735,497 | A * | 5/1973 | Boettcher | 33/526 |
| 3,787,020 | A * | 1/1974 | Avery | 249/18 |
| 3,826,057 | A * | 7/1974 | Franklin | 52/641 |
| 3,899,152 | A * | 8/1975 | Avery | 249/18 |
| 4,598,510 | A * | 7/1986 | Wagner, III | 52/126.6 |
| 4,599,830 | A * | 7/1986 | Nawrot | 52/92.2 |
| 4,620,403 | A * | 11/1986 | Field | 52/480 |
| 4,841,880 | A * | 6/1989 | Ferguson | 108/57.19 |
| 4,844,651 | A * | 7/1989 | Partridge | 403/386 |
| 4,858,399 | A * | 8/1989 | Salato, Jr. | 52/97 |

(Continued)

FOREIGN PATENT DOCUMENTS

WO 88/09413 A1 12/1988

*Primary Examiner* — Brian Glessner
*Assistant Examiner* — Joshua Ihezie
(74) *Attorney, Agent, or Firm* — Fitch Even Tabin & Flannery, LLP

(57) ABSTRACT

A tread and bearer member locating system for a modular decking system, the modular decking system including decking in the form of a plurality of treads, and the decking being carried by one or more bearer members. The treads are elongate and have a longitudinal axis, a topside, an underside and a lateral width. The tread and bearer member locating system includes treads and bearer members, wherein the underside of at least one tread includes, at or near each end thereof, a bearer member receiving area, at least one of the bearer member receiving areas being bound longitudinally between a pair of spaced apart, downwardly extending locating projections, and laterally between opposed coupling members capable of, in use, coupling with correspondingly shaped coupling members in adjacent treads.

13 Claims, 2 Drawing Sheets

U.S. PATENT DOCUMENTS 4,896,985 A * 1/1990 Commins ..... 403/11
4,965,980 A * 10/1990 Leavens ..... 52/712
5,027,573 A * 7/1991 Commins et al. ..... 52/489.2
5,218,795 A * 6/1993 Horstketter ..... 52/125.5
5,394,667 A * 3/1995 Nystrom ..... 52/480
5,485,794 A * 1/1996 Sing ..... 108/57.21
5,623,803 A * 4/1997 Willis ..... 52/650.3
5,735,097 A * 4/1998 Cheyne ..... 52/489.1
5,819,491 A 10/1998 Davis
5,836,128 A 11/1998 Groh et al.
5,850,720 A * 12/1998 Willis ..... 52/650.3
5,906,084 A * 5/1999 Millington et al. ..... 52/650.3
5,913,784 A * 6/1999 Hite ..... 52/177
5,953,878 A * 9/1999 Johnson ..... 52/582.2
6,108,992 A * 8/2000 Shaw ..... 52/302.3
6,286,272 B1 * 9/2001 Sandoz ..... 52/177
6,446,409 B1 * 9/2002 Emerson ..... 52/712
6,449,911 B1 * 9/2002 Hudson ..... 52/58
6,647,638 B1 * 11/2003 Doyal ..... 33/613
6,955,021 B2 * 10/2005 Thomas ..... 52/650.3
7,007,437 B2 * 3/2006 Thomas ..... 52/650.3
7,010,894 B1 * 3/2006 Cappelle ..... 52/480
7,028,446 B2 * 4/2006 Winchester ..... 52/746.1
7,044,460 B2 * 5/2006 Bolton ..... 269/37
7,207,150 B2 * 4/2007 Leek et al. ..... 52/747.1
7,424,794 B2 * 9/2008 Baranowski ..... 52/483.1
7,503,146 B2 * 3/2009 Thomas ..... 52/177
7,748,187 B2 * 7/2010 Sensenig ..... 52/489.1
7,900,417 B1 * 3/2011 Leines ..... 52/650.3
2002/0152712 A1 * 10/2002 Smith ..... 52/650.3
2009/0151275 A1 * 6/2009 Naccarato et al. ..... 52/182

* cited by examiner

MODULAR DECKING SYSTEM AND AN IMPROVED TREAD AND BEARER LOCATING SYSTEM THEREFOR

CROSS-REFERENCE TO RELATED APPLICATIONS

This application is a U.S. national phase application filed under 35 U.S.C. §371 of International Application PCT/AU2007/000880, filed on Jun. 27, 2007, designating the United States, which claims priority from Australian Application 2006903432, filed on Jun. 27, 2006, which are hereby incorporated herein by reference in their entirety.

FIELD OF THE INVENTION

The present invention relates to a modified and improved tread for engagement with bearer members of a modular decking system, and thus also to an improved tread and bearer member locating system for use with a modular decking system. The present invention also relates to an improved method for installing the tread and bearer members, and thus for installing the modular decking system. In this respect, the modular decking system is preferably of the type that may be used for paths, boardwalks, platforms, decking, jetties, piers, promenades, verandahs, and small crossings such as pedestrian bridges, or the like. It is envisaged that such modular decking systems will find particular use as boardwalks through environmentally sensitive areas such as wetlands and rainforests, or as promenades along foreshores.

BACKGROUND OF THE INVENTION

Most available decking systems require the use of heavy equipment for their in situ construction, and also require the preparation of substantial foundations or footings. In most situations, and certainly in environmentally sensitive situations, these requirements cause significant damage to the surrounding areas.

Additionally, many areas in which such decking systems are required are irregular in terms of terrain, and introduce planning difficulties where a flat surface is required over undulating features. In particular, laying paths, tracks or boardwalks through wetland areas requires careful planning and mapping to ensure the various components of the path are constructed correctly, whilst even a small margin of error can cause significant construction difficulties.

In general, traditional decking systems are subject to much error in such situations, with subsequent wastage of materials and delays in construction.

Furthermore, many of the environments in which such decking is required are quite harsh and will rapidly erode and damage traditional decking materials such as timber and steel. Concrete and cement, which thus become preferred materials, have typically been avoided for such decking systems due to a perception of them being difficult to use due to their weight and inflexibility in connection and securing techniques.

Our co-pending U.S. Pat. No. 5,906,084 describes an improved modular decking system which overcomes, or at least partly alleviates, the abovementioned difficulties. However, the tread and bearer member locating system described in U.S. Pat. No. 5,906,084 requires a locating pin to be received by a hole or slot in the upper surface of a bearer member and by a hole or slot in the lower surface of a tread. The correct placement and alignment of the tread on the bearer member is important to meet engineering load tolerances, to reduce sideway displacement of treads, and to ensure the structural integrity of the system.

Unfortunately, the placement of the locating pin during construction has sometimes proved time-consuming, difficult and hazardous to the installer due to the size and weight of tread and the need to keep on hand a large number of locating pins. Consequently, the installer may overlook the inclusion of the locating pin leading to poor positioning of the tread on the bearer member, outside of recommended engineering tolerances, thereby reducing the structural integrity of the decking system. Furthermore, as the locating pin is hidden from view, inspections of a constructed decking system often cannot accurately assess whether locating pins have been installed.

It is an aim of the present invention to provide a tread that will optimise the installation and inspection processes of a modular decking system to better ensure its structural integrity, and thus to provide an improved tread and bearer member locating system.

Indeed, the improved tread of the present invention will ideally reduce the number of components required for such a modular decking system (thus reducing the manufacturing cost of such a modular decking system), should enhance the speed and cost of installation, better guide installers in correct placement of members, and facilitate the final inspection of installed product.

Before turning to a summary of the present invention, it must be appreciated that the above description of the prior art has been provided merely as background to explain the context of the invention. It is not to be taken as an admission that any of the material referred to was published or known, or was a part of the common general knowledge in Australia or elsewhere.

SUMMARY OF THE INVENTION

The present invention provides a tread for use with a modular decking system that includes decking in the form of a plurality of treads, the decking being carried by one or more bearer members, the tread being elongate and having a longitudinal axis, a topside, an underside and a lateral width, wherein the underside of the tread includes, at or near each end thereof, a bearer member receiving area, at least one of the bearer member receiving areas being bound:

- longitudinally between a pair of spaced apart, downwardly extending locating projections; and
- laterally between opposed coupling members capable of, in use, coupling with correspondingly shaped coupling members in adjacent treads.

The present invention also provides a modular decking system that includes decking in the form of a plurality of treads, the decking being carried by one or more bearer members, the treads being elongate and having a longitudinal axis, a topside, an underside and a lateral width, wherein the underside of at least one tread includes, at or near each end thereof, a bearer member receiving area, at least one of the bearer member receiving areas being bound:

- longitudinally between a pair of spaced apart, downwardly extending locating projections; and
- laterally between opposed coupling members capable of, in use, coupling with correspondingly shaped coupling members in adjacent treads.

The present invention also provides a tread and bearer member locating system for a modular decking system, the modular decking system including decking in the form of a plurality of treads, the decking being carried by one or more bearer members, the treads being elongate and having a longitudinal axis, a topside, an underside and a lateral width, the tread and bearer member locating system including treads and bearer members, wherein the underside of at least one tread includes, at or near each end thereof, a bearer member receiving area, at least one of the bearer member receiving areas being bound:

longitudinally between a pair of spaced apart, downwardly extending locating projections; and laterally between opposed coupling members capable of, in use, coupling with correspondingly shaped coupling members in adjacent treads.

The present invention also provides a method for installing treads and bearer members in a modular decking system using the tread and bearer member locating system, the modular decking system including decking in the form of a plurality of treads, the decking being carried by one or more bearer members, the treads being elongate and having a longitudinal axis, a topside, an underside and a lateral width, the tread and bearer member locating system including treads and bearer members, wherein the underside of at least one tread includes, at or near each end thereof, a bearer member receiving area, at least one of the bearer member receiving areas being bound:

longitudinally between a pair of spaced apart, downwardly extending locating projections; and laterally between opposed coupling members capable of, in use, coupling with correspondingly shaped coupling members in adjacent treads;

the method including locating bearer members in suitable spaced apart positions and subsequently locating the bearer member receiving areas of a series of treads upon the bearer members to thereby form a decking.

In a preferred form, the opposed coupling members are tongue and groove coupling members that extend longitudinally along opposing edges of the underside of the tread, substantially the full distance between the locating projections.

The improved tread of the present invention allows for the accurate location of treads on bearer members. Due to the variable distance between parallel bearer members, particularly where there is a curve incorporated into a decking system, the positioning of the bearer members under the treads will vary. However, this positioning must still fall within an acceptable engineering range for each bearer member (defined at each end of a tread by outermost and innermost points along the longitudinal axis of the tread) in order for the decking to meet engineering requirements and tolerances. It is this range, regarded as the area between those outermost and innermost points and extending across the full lateral width of the bearer member, which is referred to above as the bearer member receiving area.

In the present invention, it is thus preferably this area that is between the spaced apart, downwardly extending locating projections, thus being "bound" by those projections longitudinally. It will thus be appreciated that by requiring the treads to be located upon the bearer members within this range, namely between the downwardly extending locating projections in the underside of the tread, the projections then prevent the incorrect location of the treads on the bearer members.

Furthermore, by adopting a length for the tongue and groove coupling members that is substantially equivalent to the space between the locating projections, installers are provided with a visual guide (from above) for the correct location of the treads on the bearer members, given that the locating projections (being on the underside of a tread) will not themselves be easily visible. Indeed, the correct positioning of the tongue and groove coupling members over the bearer member will hide the bearer member from view from a person standing on an installed decking, which will confirm the correct location of a tread on the bearer members for a person inspecting the decking for structural integrity and regulatory compliance.

With regard to a modular decking system that utilises the improved tread of the present invention, it should be appreciated that not every tread in an installed system will be required to include the bound bearer member receiving area described above. While it is likely that every tread will include the opposed tongue and groove coupling members, it may be sufficient for only one tread in every three or four treads (for example) to combine the spaced apart locating projections therewith. Furthermore, even for the treads that do include the spaced apart locating projections, the tread need not include pairs of projections at both ends thereof. It may be sufficient to include just one pair of projections, at only one end of a tread, and then (as mentioned above) on only one tread in every three or four (for example).

With particular regard to the locating projections, preferably they will be formed integrally with the tread, and thus will be of the same material of construction as the tread. However, the locating projections may be formed separately of the treads and then rigidly secured thereto in a suitable manner.

Also, the locating projections can be of any suitable size and shape. It is envisaged that locating projections that are generally cylindrical with a diameter in the range of 15 to 50 mm, and a height in the range of 15 to 50 mm, will suffice.

Preferably, each tread will be formed so as to be laterally symmetric about its longitudinal axis, such that the treads become multidirectional. It is thus preferred that each opposing edge has one tongue and one groove therein, arranged oppositely to the opposing tongue and groove in the other edge. In this form, a tread is able to be laid onto a bearer member without concern about whether it is oriented correctly with respect to its opposing (forward and rearward) edges. This further allows for the minimization of manufacturing costs, as only one shape of tread needs to be formed, and also for ease of installation as the treads do not need to be correctly oriented (other than having their undersides facing downwardly) before being laid on a bearer member.

Preferably, each of the components of a modular decking system formed with the tread of the present invention will be made of concrete. Concrete is a material that is not subject to rapid deterioration as a result of rotting, corrosion or erosion. Additionally, and as will be apparent from the following description, the weight of concrete members is often of assistance with the various locating and connecting requirements utilised in modular decking systems of this type. In particular, it can be seen that by providing the treads in a material such as concrete, the dead weight of the treads assists in ensuring the stability of treads.

Furthermore, it should be noted that concrete provides additional advantages in that the topside of the treads may easily be provided with textures in order to improve the aesthetics of the decking system, or for instance in order to improve the slip resistance of the tread surface. Additionally, concrete readily accepts colouring and thus the treads may be provided in suitable shades. Of course, while stating herein the advantages of concrete, it is to be appreciated that other suitable materials are not to be precluded from use with the present invention.

It will also be appreciated that modular decking systems of this type may be provided in any form, and may be provided to meet any required use. In particular, the treads may be provided as elongate planks in a traditional form to provide a path such as that commonly referred to as a boardwalk. Alternatively, the treads may be large slabs, for instance such as rectangular slabs, which are closely butted together to provide a continuous pathway. The area covered by such a decking system may be suitable for use as a platform or as a verandah around an existing structure, there being no restriction on the number of stumps or piers utilised nor or on the number of bearers utilised.

Furthermore, the decking system of the present invention may be embellished by the use of additional structures as required, such as hand-rails, guard-rails, kick-rails, chairs or seats, pergolas or covered areas, and the like. Such structures may be integral with, for example, the treads (the treads possibly being adapted to include receiving members), or may merely be secured to the decking system by any known means.

The use of a modular decking system, in conjunction with the tread and the tread and bearer member locating system of the present invention, allows for flexibility and adjustment in the construction of any such systems. The possibility of adjustment during construction, which adjustment may be attended to at virtually any stage of the construction process, prevents the need for precise dimensions and configurations to be planned before hand. This allows for the decking system to be provided by modular components that are of uniform size and configuration. Also, the installation and inspection processes of such a system better ensures its structural integrity by providing an installer (and an inspector) with an easy mechanism for testing the correct structural location of the treads with respect to the bearer members.

The improved tread reduces the number of components required for a modular decking system of the type described in our co-pending U.S. Pat. No. 5,906,084, and thus reduces the manufacturing cost of such a modular decking system. Also, by reducing the number of components, and by providing for the easy location of the treads upon the bearer members, the speed and cost of installation is reduced.

BRIEF DESCRIPTION OF DRAWINGS

The present invention will now be described in relation to a preferred embodiment thereof. In this respect, it is to be appreciated that the following description of the preferred embodiment does not limit in any way the generality of the above description.

In the drawings.

DETAILED DESCRIPTION OF THE DRAWINGS

Figure 1:
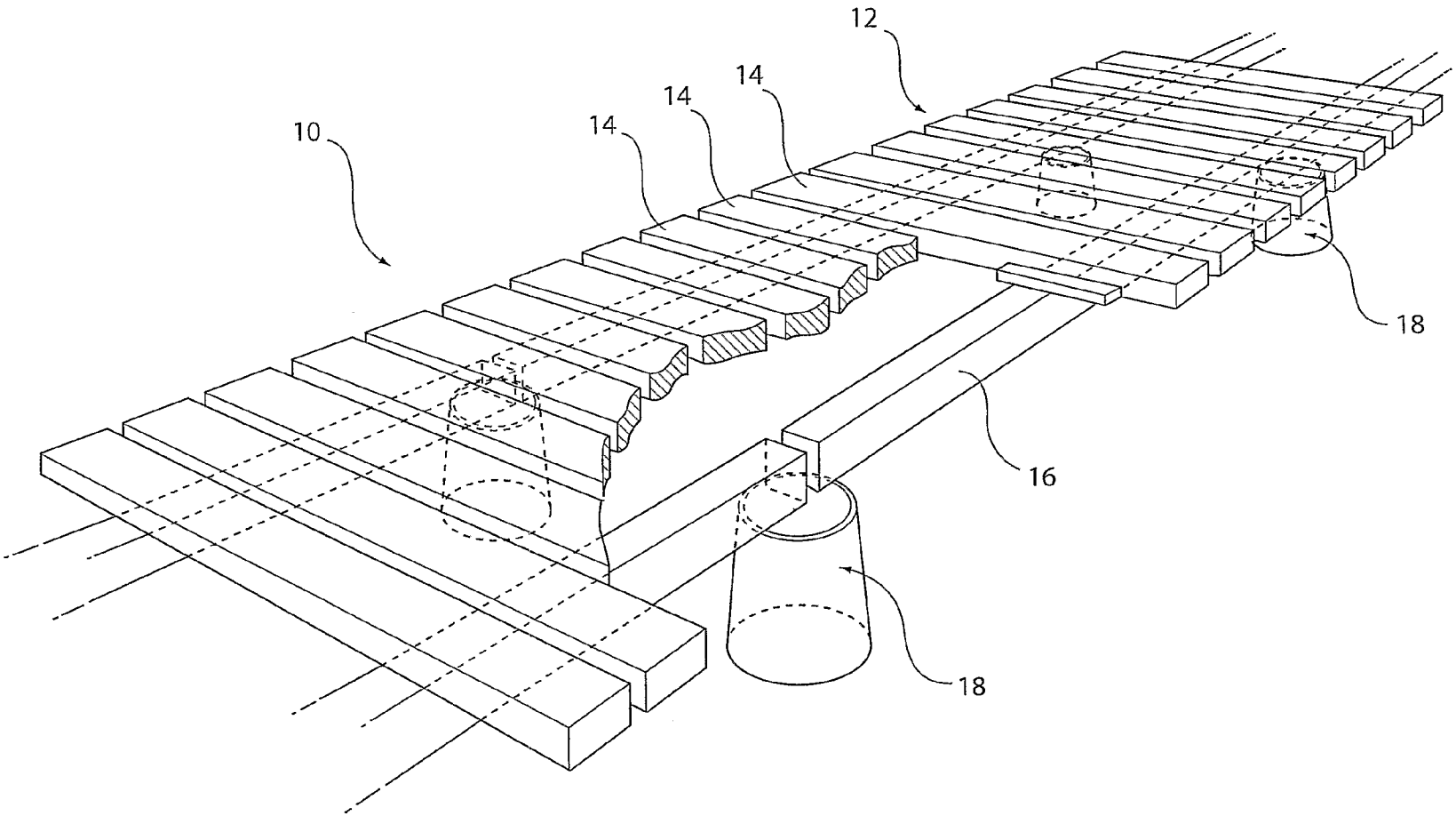
FIG. 1 is a schematic perspective view of a modular decking system in which the tread of the present invention may find use.

Illustrated in FIG. 1 is a general view of an improved modular decking system 10 constructed in accordance with an embodiment of the present invention. It will be seen from this illustration that the modular decking system 10 includes a decking 12 in the form of a plurality of treads 14 which are carried by bearer members 16, which are in turn supported by stumps 18. The stumps 18 serve to support the bearer members 16 a suitable distance above ground level. The modular decking system 10 may be used to construct a pathway, such as a boardwalk, in the form of elongate planks butted together side-by-side to form a continuous path. As mentioned above though, this is only one of many possible forms and configurations of modular decking systems of the type that fall within the scope of the present invention.

Figure 2A:
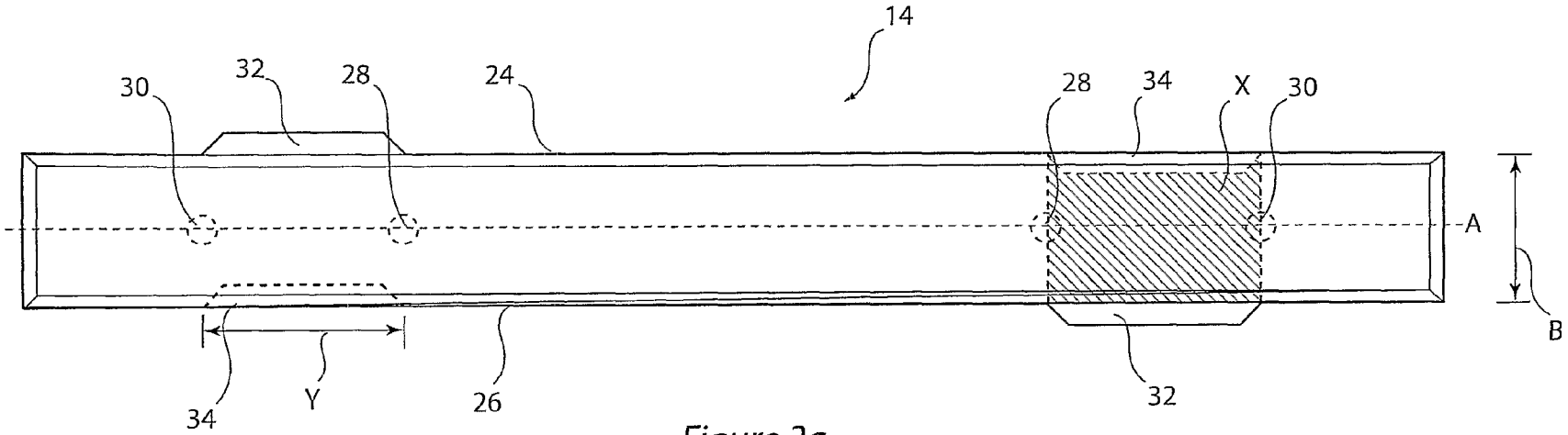
FIG. 2*a* is a view from the top of a tread in accordance with a preferred embodiment of the present invention.
Figure 2B:
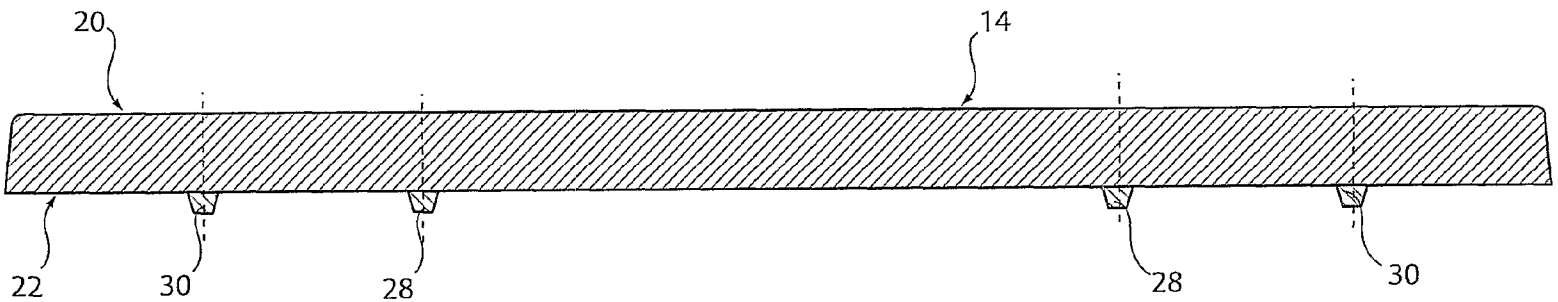
FIG. 2*b* is a side view through section A-A of the tread shown in FIG. 2*a*.

Illustrated in FIGS. 2*a* and 2*b* is a tread 14 in accordance with a preferred embodiment of the present invention. The tread 14 is elongate, having a longitudinal axis along the section line A-A and a lateral width indicated by arrow B, and also having a topside 20, an underside 22, and opposing edges (24,26) on the underside 22. In relation to the lateral width B of the tread 14, it will be appreciated that this width may vary along the length of the tread 14, so as to provide (for example) a tapered tread such as might be useful for portions of a decking 12 that might be required to traverse a corner or a curve.

The underside 22 of the tread 14 includes, towards both ends, a bearer member receiving area (one of which is marked in FIG. 2*a* as a cross-hatched area X). This bearer member receiving area X is shown bound longitudinally between a pair of spaced apart, downwardly extending locating projections (28,30), and laterally between opposed coupling members in the form of tongue 32 and groove 34 coupling members capable of, in use, coupling with correspondingly shaped groove and tongue coupling members in adjacent treads (the arrangement of adjacent treads being apparent from FIG. 1). In relation to the size and shape of the tongue 32 and the groove 34, which are shown in FIG. 2*a* as being closely matched so as to provide a snug fit of tongue 32 in groove 34, in some circumstances it may be desirable to increases the size of the groove 34 (or to decrease the size of the tongue 32) to provide some "play" between the tongue and the groove. For example, this might be useful for treads in that portion of a decking 12 that might be required to traverse a corner or a curve, and may indeed be particularly desirable for use with the tapered treads mentioned above.

In FIG. 2*a*, the tongue 32 and groove 34 coupling members at either end of the tread 14 are shown alternated from one edge 24 to the other edge 26, such that both edges do not include the like form of coupling member. However, this is not essential, and the tongue 32 and groove 34 coupling members can be arranged such that, for instance, the tongues 32 are on the same side of the tread 14. Indeed, it is possible that a tread will be provided with only tongues arranged on both edges, for engagement with an adjacent tread that may have only grooves arranged on both edges.

Having said that, there are obvious benefits to forming the tread 14 in the manner shown in FIGS. 2*a* and 2*b*, such that each tread 14 is formed so as to be laterally symmetric about its longitudinal axis, the treads 14 thus being multidirectional for installation purposes. In this form, a tread 14 is able to be laid onto a bearer member 16 without concern about whether it is oriented correctly with respect to its opposing (forward and rearward) edges. Also, this would permit the manufacture of only a single shape of tread 14, for use throughout a decking so constructed.

With this in mind, and as mentioned above, not every tread 14 in an installed modular decking system 10 will be required to include the bearer member receiving area X shown in FIG. 2*a*. While it is likely that every tread 14 will include the opposed tongue 32 and groove 34 coupling members (arranged at each end of the tread 14 as shown in FIG. 2*a*), it may be sufficient for only one tread in every few treads to combine the spaced apart locating projections (28,30) therewith. Furthermore, even for the treads that do include the spaced apart locating projections (28,30), the tread 14 need not include pairs of projections (28,30) at both ends thereof. It may be sufficient to include just one pair of projections (28,30), at only one end of a tread 14, and then on only one tread in every few, and still have the modular decking system gain the benefit of the present invention.

In FIG. 2*b*, the locating projections (28,30) are shown as generally cylindrical projections extending downwardly below the underside 22 of the tread 14. As mentioned above, these locating projections (28,30) are preferably made integral with the treads 14.

The improved tread 14 of the present invention allows for the accurate location of treads 14 on bearer members 16. As mentioned above, due to the variable distance between parallel bearer members 16, particularly where there is a curve incorporated into a decking system, the positioning of the bearer members 16 under the treads 14 will vary. However, this positioning must still fall within an acceptable engineering range for each bearer member 16 (which has been described above as being at each end of a tread 14 and defined by outermost and innermost points along the longitudinal axis of the tread, which equate to the projections 30 and 28 respectively in FIG. 2*a*), in order for the decking to meet engineering requirements and tolerances. It is this range, regarded as the area between those outermost and innermost points and extending across the full lateral width B of the bearer member, which is referred to above as the bearer member receiving area and which is identified in FIG. 2*a* by the letter X.

In the present invention, it is thus preferably this area X that is between the spaced apart, downwardly extending locating projections (28,30), and that is thus "bound" by those projections longitudinally. It will thus be appreciated that by requiring the treads 14 to be located upon the bearer members 16 within this range, namely between the downwardly extending locating projections (28,30) on the underside 22 of the tread 14, the projections (28,30) then prevent the incorrect location of the treads 14 on the bearer members 16.

Furthermore, by adopting a length Y (shown in FIG. 2*a*) for the tongue 32 and groove 34 coupling members that is substantially equivalent to the space between the locating projections (28,30), installers are provided with a visual guide (from above) for the correct location of the treads 14 on the bearer members 16, given that the locating projections (28, 30) on the underside of a tread 14 will not themselves be easily visible. Indeed, the correct positioning of the tongue 32 and groove 34 coupling members over the bearer member 16 will hide the bearer member 16 from view from a person standing on an installed decking. This will thus confirm the correct location of a tread 14 on the bearer members 16 for a person inspecting the decking for structural integrity and regulatory compliance.

In conclusion, it must be appreciated that there may be other various and modifications to the configurations described herein which are also within the scope of the present invention.

The invention claimed is:

1. A tread for use with a modular decking system that includes decking in the form of a plurality of treads, the decking being carried by one or more bearer members, the tread being elongate and having a longitudinal axis, a topside, an underside and opposite longitudinal extending sides having a lateral width therebetween, wherein the underside of the tread includes, at or near each end thereof, a predefined bearer member receiving area, at least one of the bearer member receiving areas extending longitudinally to have a predetermined length on the underside of the tread and being bound:

longitudinally between a pair of longitudinally spaced apart, downwardly extending locating projections that project downwardly from the underside of the tread and which are spaced by at least the predetermined length of the one bearer member receiving area; and laterally between opposed coupling members at the longitudinally extending sides capable of, in use, coupling with correspondingly shaped coupling members in adjacent treads with one of the opposed coupling members extending laterally outwardly from the associated longitudinally extending side of the tread and extending longitudinally between the longitudinally spaced locating projections to have a predetermined length substantially the same as that of the one bearer member receiving area and to be disposed alongside the one bearer member receiving area to substantially coincide therewith to provide an installer a visual guide from above for the correct location of the tread on one of the bearer members for placement of the underside of the tread on the one bearer member with the locating projections disposed adjacent to either side of the one bearer member.

2. A tread according to claim 1, wherein the opposed coupling members extend longitudinally along the opposite sides of the tread, substantially the full distance between the locating projections.

3. A tread according to claim 1, wherein the opposed coupling members extend longitudinally along the opposite sides of the tread so that predetermined lengths thereof are substantially equivalent to the longitudinal spacing between the locating projections.

4. A tread according to claim 1, wherein the coupling members are tongue and groove coupling members.

5. A tread according to claim 1, wherein the locating projections are formed integrally with the tread.

6. A tread according to claim 1, wherein the locating projections are generally cylindrical with a diameter in the range of 15 to 50 mm, and a height in the range of 15 to 50 mm.

7. A tread according to claim 1, wherein each tread is formed so as to be laterally symmetric about its longitudinal axis.

8. A tread according to claim 7, wherein the opposite sides and the opposed coupling members are arranged and configured such that each opposite side has one tongue and one groove therein, arranged oppositely to the opposing tongue and groove in the other side.

9. A modular decking system that includes decking in the form of a plurality of treads, the decking being carried by one or more bearer members, the treads being elongate and having a longitudinal axis, a topside, an underside and a lateral width, wherein the underside of at least one tread includes, at or near each end thereof, a bearer member receiving area, at least one of the bearer member receiving areas extending longitudinally, being predefined to have a predetermined length on the underside of the tread, and being bound:

longitudinally between a pair of spaced apart, downwardly extending locating projections which are spaced by at least the predetermined length of the one bearer member receiving area; and laterally between opposed coupling members capable of, in use, coupling with correspondingly shaped coupling members in adjacent treads with one of the opposed coupling members extending laterally outwardly from a longitudinally extending side of the tread and extending longitudinally between the longitudinally spaced locating projections to have a predetermined length substantially the same as that of the one bearer member receiving area and to be disposed alongside the one bearer member receiving area to substantially coincide therewith to provide an installer a visual guide from above for the correct location of the tread on one of the bearer members for placement of the underside of the tread on the one bearer member with the locating projections disposed adjacent to either side of the one bearer member.

10. A modular decking system according to claim 9 including one or more treads in accordance with any one of claims 1 to 8.

11. A tread and bearer member locating system for a modular decking system, the modular decking system including decking in the form of a plurality of treads, the decking being carried by one or more bearer members, the treads being elongate and having a longitudinal axis, a topside, an underside and a lateral width, the tread and bearer member locating system including treads and bearer members, wherein the underside of at least one tread includes, at or near each end thereof, a bearer member receiving area, at least one of the bearer member receiving areas extending longitudinally, being predefined to have a predetermined length on the underside of the tread, and being bound:

longitudinally between a pair of spaced apart, downwardly extending locating projections which are spaced by at least the predetermined length of the one bearer member receiving area; and laterally between opposed tongue and groove coupling members capable of, in use, coupling with correspondingly shaped groove and tongue coupling members in adjacent treads with one of the opposed tongue coupling members extending laterally outwardly from a longitudinally extending side of the tread and extending longitudinally between the longitudinally spaced locating projections to have a predetermined length substantially the same as that of the one bearer member receiving area and to be disposed alongside the one bearer member receiving area to substantially coincide therewith to provide an installer a visual guide from above for the correct location of the tread on one of the bearer members for placement of the underside of the tread on the one bearer member with the locating projections disposed adjacent to either side of the one bearer member.

12. A tread and bearer member locating system according to claim 11 including one or more treads in accordance with any one of claims 1 to 8.

13. A method for installing treads and bearer members in a modular decking system using a tread and bearer member locating system, the modular decking system including decking in the form of a plurality of treads, the decking being carried by one or more bearer members, the treads being elongate and having a longitudinal axis, a topside, an underside and a lateral width, the tread and bearer member locating system including treads and bearer members, wherein the underside of at least one tread includes, at or near each end thereof, a predefined bearer member receiving area, at least one of the bearer member receiving areas extending longitudinally to have a predetermined length on the underside of the tread and being bound:

longitudinally between a pair of spaced apart, downwardly extending locating projections which are spaced by at least the predetermined length of the one bearer member receiving area; and laterally between opposed coupling members capable of, in use, coupling with correspondingly shaped coupling members in adjacent treads with one of the opposed coupling members extending laterally outwardly from a longitudinally extending side of the tread and extending longitudinally between the longitudinally spaced locating projections to have a predetermined length substantially the same as that of the one bearer member receiving area and to be disposed alongside the one bearer member receiving area to substantially coincide therewith to provide an installer a visual guide from above for the correct location of the tread on one of the bearer members for placement of the underside of the tread on the one bearer member with the locating projections disposed adjacent to either side of the one bearer member;

the method including locating bearer members in suitable spaced apart positions and subsequently locating the bearer member receiving areas of a series of treads upon the bearer members to thereby form a decking.

* * * * *